US008156689B2

(12) United States Patent
Benzinger

(10) Patent No.: US 8,156,689 B2
(45) Date of Patent: Apr. 17, 2012

(54) LARGE-CAPACITY BOOTH FOR THE TREATMENT, IN PARTICULAR THE SPRAYING AND/OR DRYING, OF WORKPIECES

(75) Inventor: Rainer Benzinger, Boeblingen (DE)

(73) Assignee: Eisenmann AG (DE)

( * ) Notice: Subject to any disclaimer, the term of this patent is extended or adjusted under 35 U.S.C. 154(b) by 677 days.

(21) Appl. No.: 11/935,703

(22) Filed: Nov. 6, 2007

(65) Prior Publication Data

US 2008/0110104 A1 May 15, 2008

(30) Foreign Application Priority Data

Nov. 9, 2006 (DE) ..... 10 2006 052 854

(51) Int. Cl.
*E04B 2/76* (2006.01)
*E04B 2/78* (2006.01)
*E04H 1/12* (2006.01)

(52) U.S. Cl. ..... 52/36.2; 52/582.2; 52/79.1

(58) Field of Classification Search ..... 52/36.1, 52/36.2, 79.1, 653.1, 618, 582.1, 584.1, 79.9, 52/578, 79.7, 79.8, 79.12, 633, 650.3, 696, 52/263, 289, 106
See application file for complete search history.

(56) References Cited

U.S. PATENT DOCUMENTS

| | | | | | |
|---|---|---|---|---|---|
| 797,474 | A | * | 8/1905 | Walker | 52/63 |
| 1,092,503 | A | * | 4/1914 | Moore | 403/174 |
| 2,078,011 | A | * | 4/1937 | Neher | 52/476 |
| 2,482,918 | A | * | 9/1949 | Kump, Jr. | 52/64 |
| 2,691,291 | A | * | 10/1954 | Henderson | 52/79.9 |
| 2,871,997 | A | * | 2/1959 | Simpson et al. | 52/93.1 |
| 3,058,549 | A | * | 10/1962 | Anderson | 52/127.1 |
| 3,343,321 | A | * | 9/1967 | Axelsson | 52/296 |
| 3,500,596 | A | * | 3/1970 | Andersson | 52/79.7 |
| 3,564,783 | A | * | 2/1971 | Dunne | 52/38 |
| 3,685,229 | A | * | 8/1972 | Sale et al. | 52/783.16 |
| 3,838,879 | A | * | 10/1974 | Lilly | 52/143 |
| 4,133,255 | A | * | 1/1979 | Guice | 454/52 |
| 4,347,690 | A | * | 9/1982 | Wallace, Jr. | 52/93.1 |
| 4,425,870 | A | * | 1/1984 | Marshke | 118/326 |
| 4,467,573 | A | * | 8/1984 | Langerbeck | 52/79.5 |
| RE31,807 | E | * | 1/1985 | Knowles | 52/693 |
| 4,633,626 | A | * | 1/1987 | Freeman et al. | 52/71 |
| 4,700,615 | A | * | 10/1987 | Napadow | 454/54 |
| 5,034,042 | A | * | 7/1991 | Allen, Jr. | 55/385.2 |
| 5,153,034 | A | * | 10/1992 | Telchuk et al. | 427/424 |
| 5,245,802 | A | * | 9/1993 | Davis | 52/86 |

(Continued)

FOREIGN PATENT DOCUMENTS

DE 1 276 323 A 8/1968

(Continued)

*Primary Examiner* — Khoi Tran
*Assistant Examiner* — Jason Holloway
(74) *Attorney, Agent, or Firm* — Factor Intellectual Property Law Group, Ltd.

(57) ABSTRACT

A large-capacity booth for the treatment, in particular for the spraying and/or drying, of workpieces, in particular motor vehicles, rail vehicles, aircraft or watercraft, having at least two opposite booth walls and one booth ceiling is described. The booth walls each have at least two vertical supports composed of open sectional elements, which are connected to one another via wall elements. The booth ceiling has at least two lattice beams extending in a planar manner in the vertical direction and composed essentially of open sectional elements. The lattice beams connect mutually opposite supports of the booth walls in such a way that the booth walls and the booth ceiling stabilize one another.

20 Claims, 10 Drawing Sheets

U.S. PATENT DOCUMENTS

| | | | | |
|---|---|---|---|---|
| 5,388,376 | A * | 2/1995 | Demeyer | 52/6 |
| 5,396,742 | A * | 3/1995 | Romig et al. | 52/79.9 |
| 5,512,017 | A * | 4/1996 | Gore et al. | 454/52 |
| 5,577,353 | A * | 11/1996 | Simpson | 52/92.2 |
| 5,679,071 | A * | 10/1997 | Proctor | 454/52 |
| 5,761,873 | A * | 6/1998 | Slater | 52/693 |
| 5,771,655 | A * | 6/1998 | Strickland et al. | 52/745.2 |
| 5,782,943 | A * | 7/1998 | O'Ryan et al. | 55/332 |
| 5,802,772 | A * | 9/1998 | Burke et al. | 52/6 |
| 6,098,350 | A * | 8/2000 | Kochtitzky | 52/136 |
| 6,148,574 | A * | 11/2000 | Chapman | 52/289 |
| 6,212,850 | B1 * | 4/2001 | Branson | 52/745.01 |
| 6,230,470 | B1 * | 5/2001 | Kimmerle et al. | 52/762 |
| 6,293,057 | B1 * | 9/2001 | Amos Hays | 52/79.1 |
| 6,514,305 | B2 * | 2/2003 | Stephens et al. | 55/413 |
| 6,519,900 | B1 * | 2/2003 | Pierce | 52/66 |
| 6,533,654 | B2 * | 3/2003 | DeRegge | 454/52 |
| 6,584,741 | B1 * | 7/2003 | Hatzinikolas | 52/289 |
| 6,651,392 | B2 * | 11/2003 | Ritzal | 52/36.2 |
| 6,691,488 | B2 * | 2/2004 | Branson | 52/745.01 |
| 6,742,310 | B1 * | 6/2004 | Weeks | 52/92.2 |
| 6,758,022 | B1 * | 7/2004 | Coll et al. | 52/690 |
| 6,892,502 | B1 * | 5/2005 | Hubbell et al. | 52/633 |
| 6,907,695 | B2 * | 6/2005 | Pierce | 52/66 |
| 7,014,338 | B2 * | 3/2006 | Pippa et al. | 362/253 |
| 7,045,013 | B2 * | 5/2006 | DeRegge | 118/326 |
| 7,082,707 | B2 * | 8/2006 | Poot | 40/612 |
| 7,666,077 | B1 * | 2/2010 | Thelen | 454/50 |
| 2001/0052204 | A1 * | 12/2001 | Schwenkler et al. | 52/79.1 |
| 2002/0046534 | A1 * | 4/2002 | Heinly et al. | 52/693 |
| 2002/0059774 | A1 * | 5/2002 | Collins | 52/690 |
| 2002/0148188 | A1 * | 10/2002 | Rizzotto | 52/653.1 |
| 2004/0118073 | A1 * | 6/2004 | Collins | 52/690 |
| 2005/0068774 | A1 * | 3/2005 | Pippa et al. | 362/253 |
| 2005/0247007 | A1 * | 11/2005 | Iri et al. | 52/650.1 |
| 2008/0229699 | A1 * | 9/2008 | Nehls | 52/653.1 |

FOREIGN PATENT DOCUMENTS

| | | | |
|---|---|---|---|
| DE | 1434701 | A | 12/1968 |
| DE | 197 39 642 | A1 | 3/1999 |
| DE | 197 39 644 | A1 | 3/1999 |
| DE | 299 22 479 | U1 | 5/2000 |
| EP | 0 647 476 | A1 | 4/1995 |

* cited by examiner

LARGE-CAPACITY BOOTH FOR THE TREATMENT, IN PARTICULAR THE SPRAYING AND/OR DRYING, OF WORKPIECES

CROSS-REFERENCE TO RELATED APPLICATIONS

This application claims priority to German Patent Application No. 10 2006 052 854.9, filed Nov. 9, 2006, the contents of which are incorporated herein by reference.

TECHNICAL FIELD

The invention relates to a large-capacity booth for the treatment, in particular for the spraying and/or drying, of workpieces, in particular motor vehicles, rail vehicles, aircraft or watercraft, having at least two opposite booth walls and one booth ceiling.

BACKGROUND OF THE INVENTION

Large-capacity booths known on the market are used where workpieces with relatively large surfaces are to be treated. For example, rail vehicles, buses and aircraft are pretreated, painted and dried in such large-capacity booths.

SUMMARY OF THE INVENTION

Hitherto, such large-capacity booths have been built of masonry or had welded structural steel portals composed of hollow sections or I-beams. In some cases, the structural steel portals are connected to the building in which the large-capacity booth is situated.

An object of the present invention is to design a large-capacity booth of the type mentioned at the outset such that it can be easily assembled and is self-supporting.

This object may be achieved according to the present invention in that the booth walls each have at least two vertical supports composed of open sectional elements, which are connected to one another via wall elements, and the booth ceiling has at least two lattice beams extending in a planar manner in the vertical direction and composed essentially of open sectional elements, and the lattice beams connect mutually opposite supports of the booth walls in such a way that the booth walls and the booth ceiling stabilise one another.

According to the invention, the open sectional elements are thus connected to one another in a mutually stabilising manner in such a way that they form a self-supporting skeleton for the large-capacity booth. Massive masonry walls or connections to the building are therefore not required. Open sectional elements, preferably C- or U-shaped sectional elements, are lighter than closed sectional elements, in particular hollow sections, and also easy to produce from coil materials by cutting and bending. Moreover, in contrast to I-beams, they have an interior space, for example for the passing-through of lines, which is accessible from outside and via which the sectional elements can also be easily bolted or riveted at their walls.

In an advantageous embodiment, the booth ceiling and/or the booth walls may be composed of modules. In this way, they may be preassembled at the factory, transported to the installation site and assembled there quickly and easily into finished large-capacity booths.

In order to increase the stability of the large-capacity booth, without additional components being required, each booth ceiling module may have, at least on the side on which it adjoins an adjacent booth ceiling module, one of the lattice beams, which is closely connected to the corresponding lattice beam of the adjacent booth ceiling module.

It has further proved to be favourable with regard to the stability of the large-capacity booth if each booth wall module has, at least on the side on which it adjoins an adjacent booth wall module, one of the supports, which is closely connected to the corresponding support of the adjacent booth wall module.

Expediently, in particular the connections of the supports to the wall elements and the lattice beams may be detachable, in particular bolted. In this way, the large-capacity booth may be easily converted or dismantled.

Furthermore, the wall elements may be spray booth system-walls ("SBS-walls") and/or C panels, which are light, sturdy and easy to assemble.

Advantageously, the sectional elements of the lattice beams have U-shaped sections, so that they are particularly light but nevertheless stable.

The sectional elements of the supports may also have C-shaped sections, so that they are flexurally stable transversely in all directions and have webs for fastening the wall elements.

The sectional elements may be easily bent from flat material, in particular may be cut and bent sheet-metal parts.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplary embodiment of the invention is explained in more detail below with reference to the drawing, in which FIG. 1 schematically shows an isometric view of a ceiling-and-wall module of a large-capacity booth.

DETAILED DESCRIPTION OF THE PRESENT INVENTION

Figure 1:
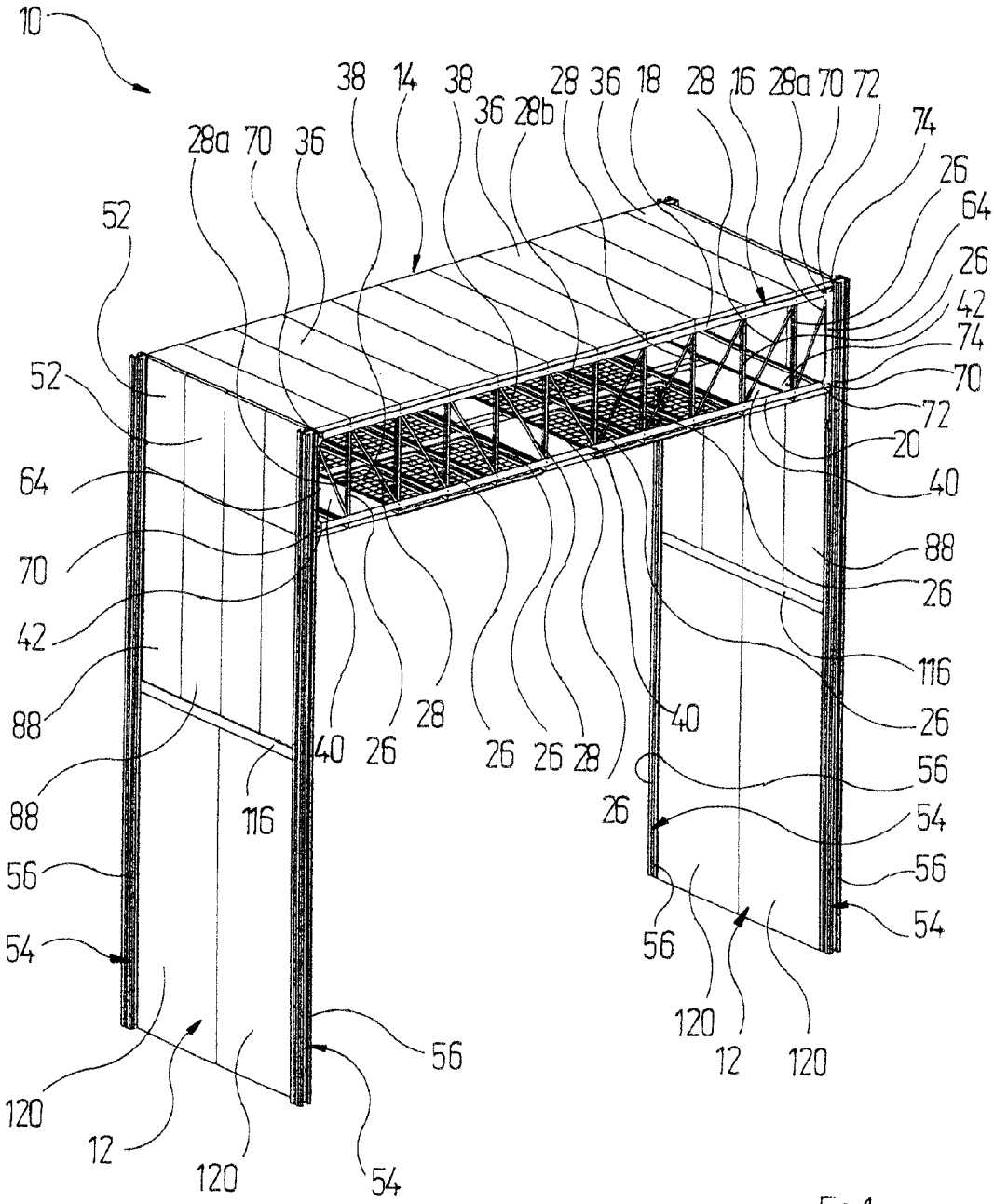

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

FIG. 1 illustrates a ceiling-and-wall module, provided as a whole with the reference symbol 10, of a large-capacity booth, otherwise not shown, for pretreating, painting and drying motor vehicles, rail vehicles, aircraft and watercraft.

The ceiling-and-wall module 10 comprises two opposite vertical booth wall modules 12 which are connected to one another via a horizontal booth ceiling module 14. The booth ceiling of the complete large-capacity booth is composed of a multiplicity of such booth ceiling modules 14 and the booth walls of the complete large-capacity booth are composed of a multiplicity of booth wall modules 12.

The booth ceiling module 14 is in the form of a cuboid-shaped box.

Figure 2:
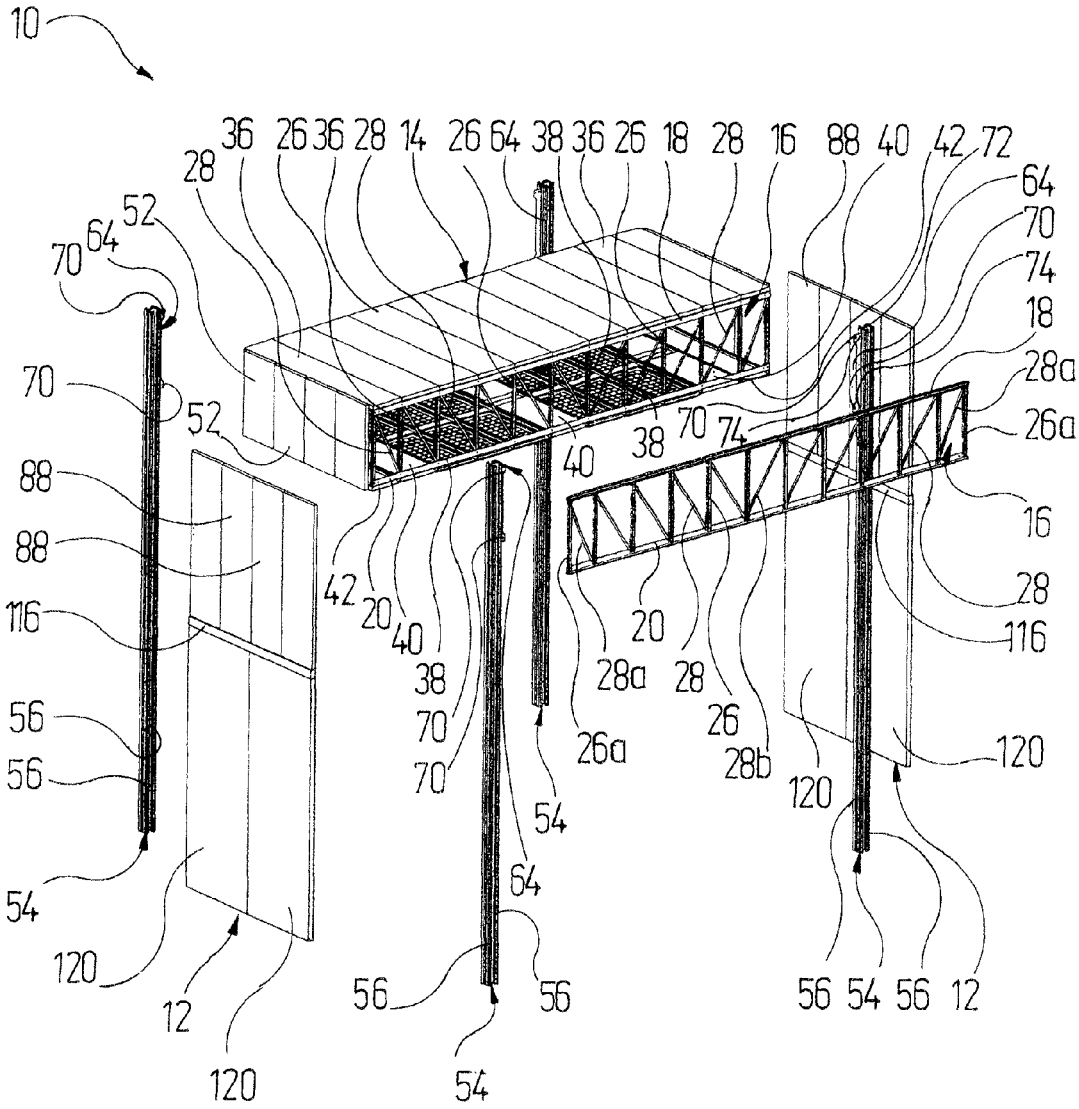
FIG. 2 schematically shows an exploded view of the ceiling-and-wall module according to FIG. 1, with a lattice beam of an adjacent ceiling-and-wall module.

The vertical transverse sides (front and rear sides), running perpendicularly to the booth walls, of the booth ceiling module 14 are each formed by a lattice beam 16 which extends in a planar manner. FIG. 2 additionally shows, to the right of the booth ceiling module 14, a second lattice beam 16 of an adjacent booth ceiling module 14, otherwise not shown in FIG. 2.

Figure 3:
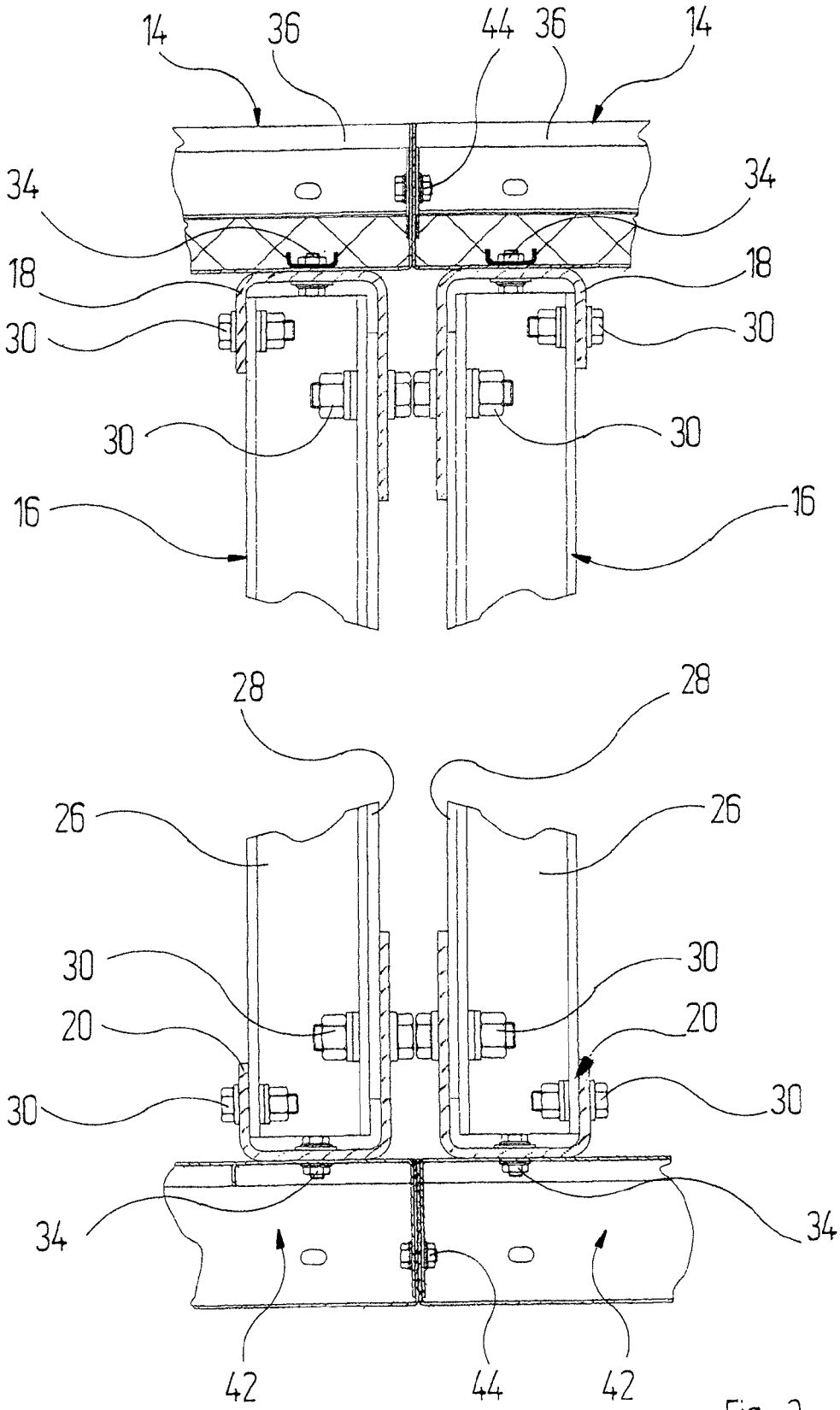
FIG. 3 schematically shows a detail view of a vertical section of the ceiling modules of two adjoining ceiling-and-wall modules according to FIG. 1 in the region of the lattice beams.

Each lattice beam 16 comprises a straight upper chord 18 and a straight lower chord 20, which extend in the horizontal direction parallel to one another as well as vertically one below the other and perpendicularly to the booth walls. The upper chord 18 and the lower chord 20 are cut and bent sheet-metal sections with double-right-angled, approximately U-shaped, i.e. open cross-sections, as shown in FIG. 3. FIG. 3 shows the two lattice beams 16 from FIG. 2 of the two adjacent booth ceiling modules 14, which are detachably bolted by through-bolts 22, shown for their part in FIG. 4, at a distance from one another with the use of spacers 24, so that overall a double lattice beam 16 is formed.

The legs of the U of the upper chord 18 and of the lower chord 20 are of different length. The upper chord 18 and the lower chord 20 are each open towards the other chord. The short legs of the upper chord 18 and of the lower chord 20 run vertically and are situated on the side facing the interior of the booth ceiling module 14. The closed bottom walls of the upper chord 18 and of the lower chord 20 are horizontally arranged.

The upper chord 18 and the lower chord 20 are connected to one another via twelve tension and compression members 26 parallel to one another and running perpendicularly to the upper chord 18 and to the lower chord 20 (FIGS. 1 and 2). The tension and compression bars 26 are likewise cut and bent sheet-metal sections with a double-right-angled, U-shaped cross-section, as can be seen from FIG. 4, the legs of the tension and compression members 26 being of equal length.

The legs of the tension and compression members 26 run parallel to the legs of the upper chord 18 and of the lower chord 20. Their bottom walls extend perpendicularly to the legs and to the bottom walls of the upper chord 18 and of the lower chord 20. The distance between the outer surfaces of the two legs of the tension and compression members 26 is less than the distance between the inner surfaces of the two legs of the upper chord 18 and of the lower chord 20. Each tension and compression member 26 reaches with its ends into the region between the legs of the upper chord 18 and of the lower chord 20, there being arranged, between the long leg of the upper chord 18 and of the lower chord 20 and the corresponding leg of the tension and compression member 26, in each case one end of a tension member 28, explained in more detail later on. Each tension and compression member 26 is bolted at its two legs to the corresponding leg of the upper chord 18 and of the lower chord 20 in each case by a through-bolt 30, shown in FIGS. 3, 4 and 6. The through-bolt 30 in the long legs of the upper chord 18 and of the lower chord 20 also passes through the end of the corresponding tension member 28.

The two outer tension and compression members **26*a* (FIG. 2), which are hidden in FIG. 1, terminate at the respective ends of the upper chord 18 and of the lower chord 20 and thus bound the transverse sides of the lattice beam 16**.

The distances between the inner ten tension and compression members 26 are equal and somewhat greater than the distances between the outer tension and compression members **26*a* and their respectively adjacent inner tension and compression members 26**.

One of the tension members 28 runs in each case between two adjacent tension and compression members 26 and is fastened to them. The tension members 28 are flat elongated sheet-metal plates. They extend in each case obliquely from that end of one tension and compression member 26 facing the upper chord 18 to that end of the other tension and compression member 26 facing the lower chord 20. Those tension members 28 which are connected to the outer tension and compression members **26*a* run in each case to that end of the latter facing the upper chord 18**.

The orientation relative to the tension and compression members 26 of the next four inner tension members 28 respectively, seen from the outer tension and compression members **26*a* in the direction towards the other tension and compression member 26*a* respectively, corresponds to the orientation of the outer tension member 28*a* nearest to the respective outer tension and compression member 26*a*. The tension member 28*b* situated in the middle of the lattice beam 16 between the fifth and the sixth tension and compression member 26 is oriented such that, seen perpendicularly to the transverse sides of the booth ceiling module 14, it crosses the corresponding tension member 28*b* of the lattice beam 16 of the adjoining booth ceiling module 14, as can be seen from FIG. 2**.

Figure 4:
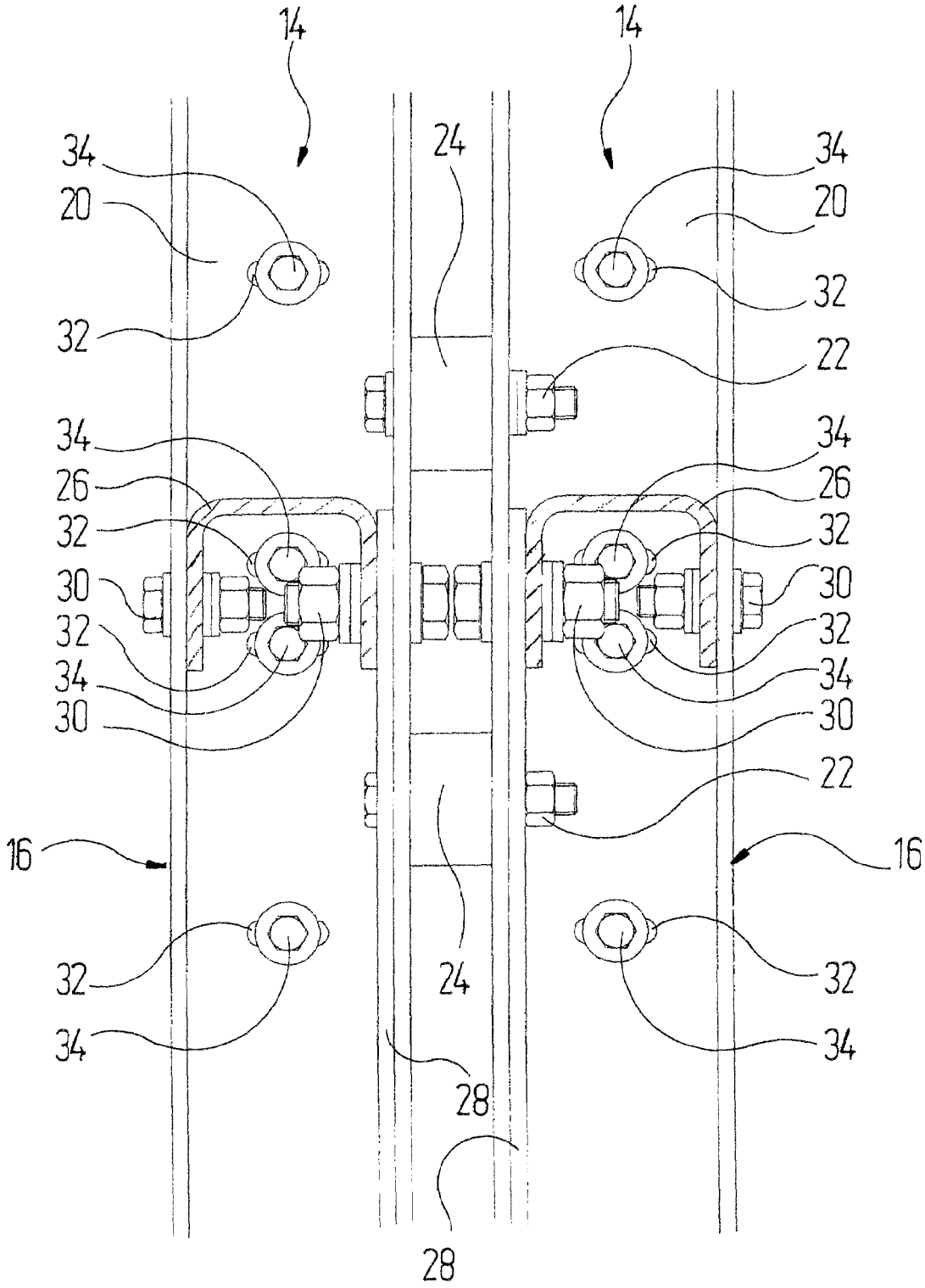
FIG. 4 schematically shows a horizontal section of the lattice beams according to FIG. 3.
Figure 6:
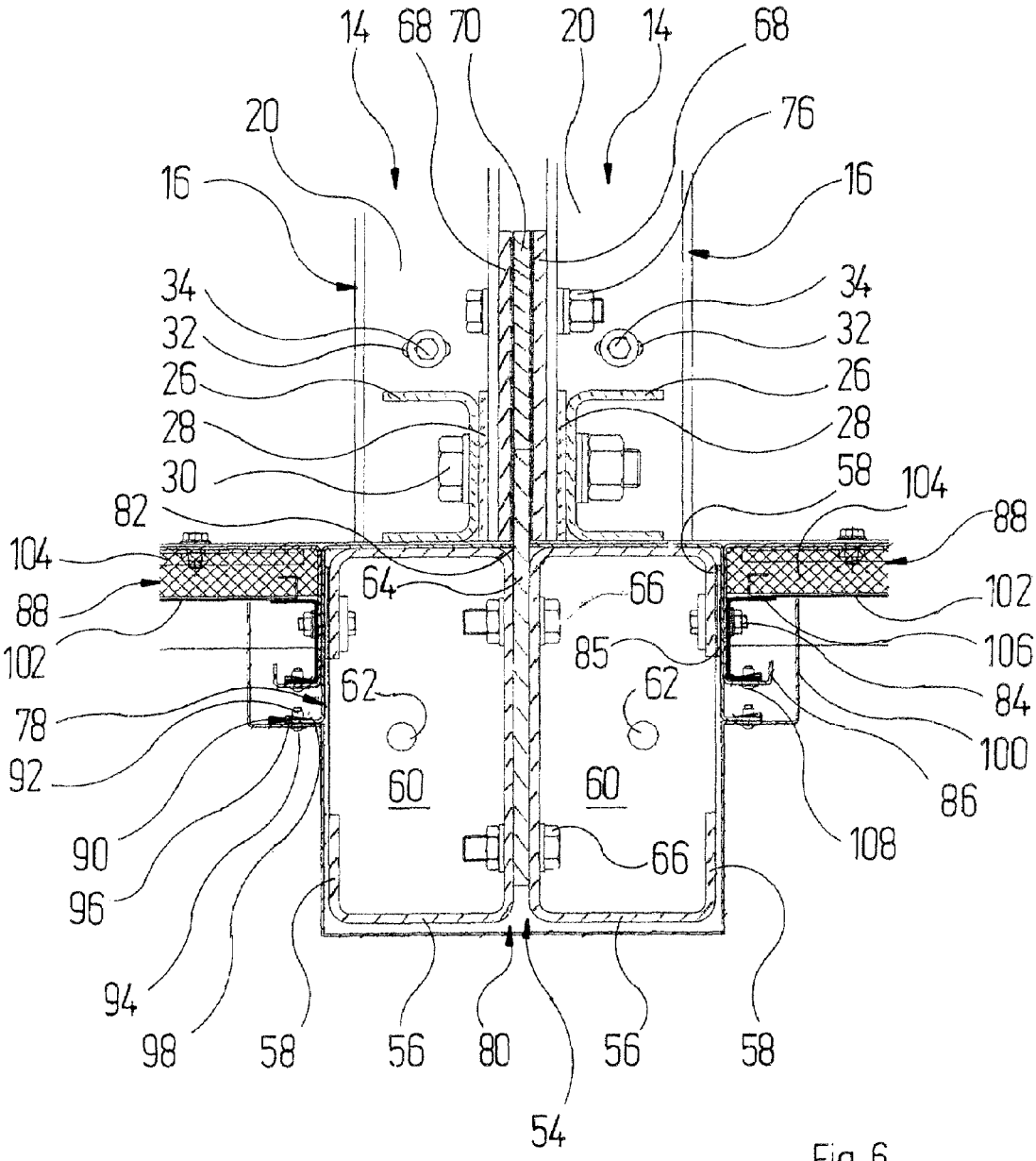
FIG. 6 schematically shows a horizontal section of a double support for adjacent wall modules of the two ceiling-and-wall modules according to FIGS. 3 and 4 in the region of the ceiling modules.

The bottom walls of the upper chord 18 and of the lower chord 20 additionally have a multiplicity of elongated through-holes 32, which can be seen in FIGS. 4 and 6. The elongated holes 32 are arranged such that they lie in the transverse direction midway between the legs of the upper chord 18 and of the lower chord 20. In their longitudinal directions, the elongated holes 32 run perpendicularly to the mid-plane, i.e. perpendicularly to the longitudinal direction of the upper chord 18 and of the lower chord 20. In the region of the tension and compression members 26, two of the elongated holes 32 are arranged close together equidistantly from the plane which is perpendicular to the bottom wall of the upper chord 18 and of the lower chord 20 and contains the axes of the through-bolts 30 at the ends of the tension and compression members 26.

The elongated holes, hidden in FIG. 3, in the upper chords 18 serve for the passing-through of through-bolts 34 for fastening eleven flat trough-shaped, elongated ceiling elements 36. The ceiling elements 36 carry insulating elements and are closed at the top by covers.

The elongated holes 32 in the lower chords 20 serve for the passing-through of corresponding through-bolts 34 for fastening a total of eleven filter ceiling elements 38, lighting ceiling elements 40 and inner ceiling elements 42, which are shown in cross-section in FIG. 5 and described in more detail later on.

Seen in their longitudinal direction, the ceiling elements 36 are each fastened at their end regions on the upper chord 18 of the two lattice beams 16 of the booth ceiling module 14. They rest there on the bottom walls of the upper chords 18. In the assembled state of the booth ceiling module 14 (FIG. 1), the ceiling elements 36 run horizontally. The width of the ceiling elements 36 corresponds to the distance between the two adjacent tension and compression members 26 above which it is arranged. The two outer ceiling elements 36 are therefore narrower than the inner ones.

The ceiling elements 36 are arranged close together and tightly close the booth ceiling module 14. Adjacent ceiling elements 36 are bolted together at their longitudinal sides by through-bolts, not shown in FIGS. 1 to 9.

The narrow sides of the ceiling elements 36 project beyond the bottom walls of the upper chords 18 in such a way that they butt against the narrow sides of the corresponding ceiling elements 36 of the adjacent booth ceiling module 14 (FIG. 3). The mutually abutting ceiling elements 36 of adjacent booth ceiling modules 14 are bolted together at their end sides by through-bolts 44.

The six filter ceiling elements 38, three lighting ceiling elements 40 and two inner ceiling elements 42, which all have the same external dimensions as the corresponding ceiling elements 36, are arranged on the surfaces, facing away from the upper chords 18, of the bottom walls of the lower chords 20 of the two lattice beams 16 of the booth ceiling module 14 analogously to the ceiling elements 36 (FIGS. 1, 2, 3 and 5).

The filter ceiling elements 38 contain bent, filter-element-carrying coil plates with apertures, so that they are air-permeable. The apertures are approximately 150 mm×150 mm in size. They are bounded by webs having a web width of 10 mm.

The lighting ceiling elements 40 carry known lighting elements for lighting the booth interior.

The longitudinal edges of the filter ceiling elements 38, of the lighting ceiling elements 40 and of the inner ceiling elements 42 are aligned with the corresponding tension and compression members 26. The inner ceiling elements 42 each adjoin the booth walls. Situated beside each inner ceiling element 42 is one of the lighting ceiling elements 40, adjacent to each of which is a group of three filter ceiling elements 38. The third lighting ceiling element 40 lies between both groups of filter ceiling elements 38.

Figure 5:
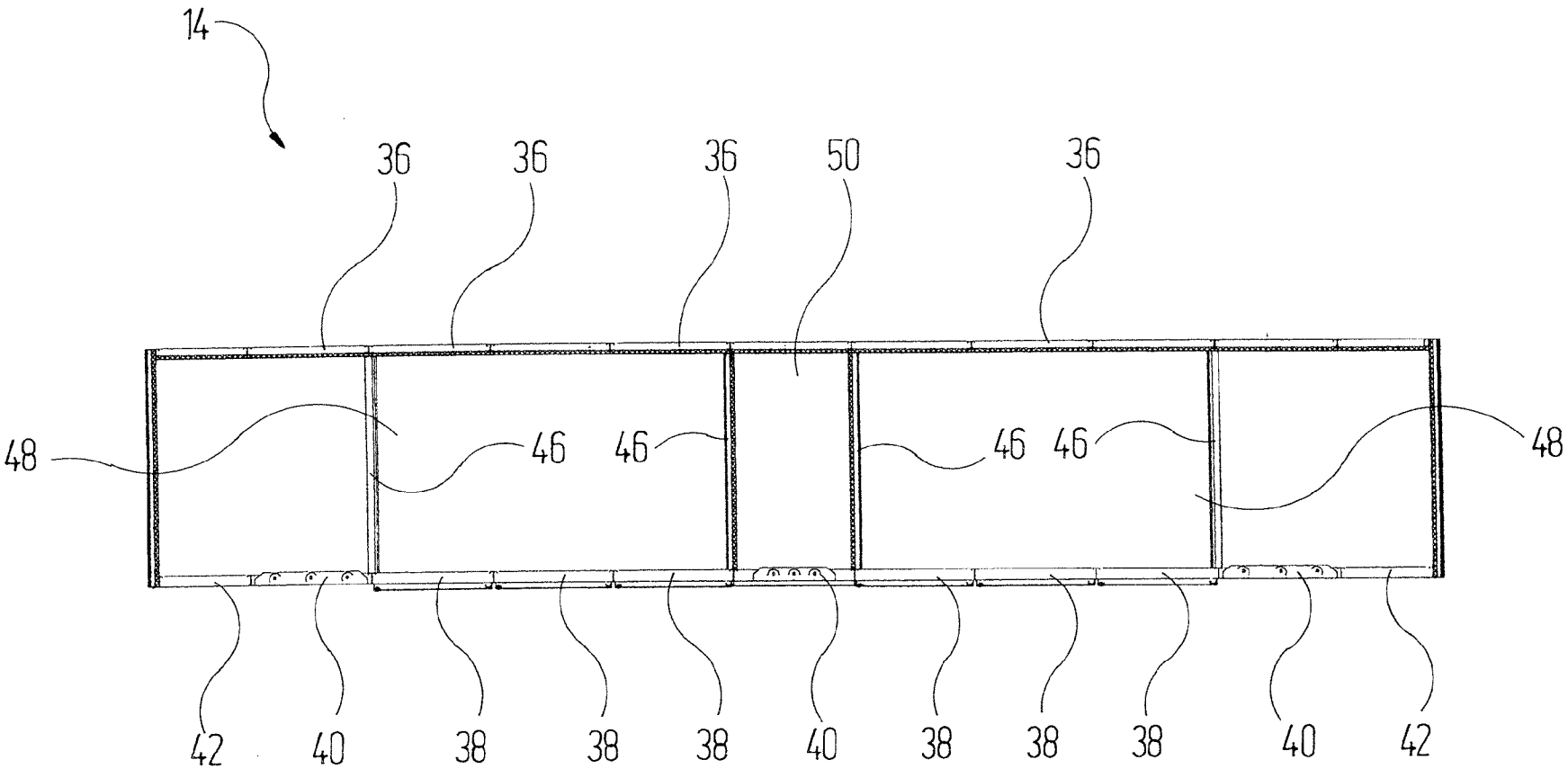
FIG. 5 schematically shows the ceiling module according to FIGS. 1 to 4 without the lattice beam in a front view.

On both sides of each group of filter ceiling elements 38 there is arranged in each case one partition wall 46, illustrated in FIG. 5, which runs parallel to the booth walls. The partition walls 46 extend in the vertical direction from the corresponding filter ceiling elements 38 to the ceiling elements 36 and in the horizontal direction in each case as far as the lattice beams 16.

The partition walls 46 thus bound, with the filter ceiling elements 38 and the corresponding ceiling elements 36, a total of two ventilation ducts 48, via which air can be supplied to the interior of the large-capacity booth through the filter ceiling elements 38 for ventilation purposes.

The central lighting ceiling element 40 bounds, together with the adjoining partition walls 46 and the corresponding ceiling element 36, a central duct 50. When the large-capacity booth is used for treating fuselages, during operation air is supplied through the central duct 50 to two rear ducts, not shown in FIGS. 1 to 9, projecting into the interior space of the large-capacity booth, for the purpose of internal ventilation of the fuselage. The rear ducts have wide-angle nozzles, by which the air is blown horizontally into the booth interior space. The rear ducts are each displaceable towards the nearest booth wall in order to create a passage for the fuselage to be brought in.

The sides of the booth ceiling module 14 which run perpendicularly to the lattice beams 16 in the extension of the booth walls are each closed by four plate-shaped side wall elements 52 (cf. FIG. 1). The side wall elements 52 extend vertically over the entire height of the booth ceiling module 14 from the inner ceiling element 42 to the corresponding outer ceiling element 36.

The side wall elements 52 are placed tightly against one another and bolted to the corresponding inner ceiling element 42 and the corresponding ceiling element 36 by through-bolts, not shown in FIGS. 1 to 9.

The respectively outer longitudinal edges of the two outer side walls 52 end a short distance in front of the lattice beams 16. There, the respective outer tension and compression members 26*a* are freely accessible from the transverse side of the booth ceiling module 14 and rest in each case against a support section 56 of the booth walls, by which support sections the booth ceiling module 14 is supported in the manner described below.

A double support 54, composed of the support sections 56 of two adjacent booth wall modules 12, is shown in different horizontal sections in FIGS. 6 to 9. The double support 54 supports the adjacent booth ceiling modules 14. The horizontal section plane runs in FIG. 6 parallel to the ceiling elements 36 between the upper chords 18 and the lower chords 20 of the lattice beams 16 connected to one another in the manner described above.

The support sections 56 are in the form of bent sheet-metal sections with double-right-angled, approximately C-shaped, i.e. open cross-sections. Double-right-angled C-shaped here means that the bent sheet-metal sections have a rectangular cross-section and one of the walls is interrupted at its centre, i.e. is open, such that on both sides of the opening there remains one web 58 each.

The support sections 56 have their closed rear walls facing one another. At their end sides, they are each closed by an end plate 60; in FIGS. 6 to 9, only the end plates 60 on the lower end side of the support sections 56 which faces away from the booth ceiling modules 14 are shown. The end plates 60 each have a central bore 62 for a bolt (not shown), by which the double support 54 can be bolted to a building floor and a building ceiling.

Situated between the rear walls of the two support sections 56 is a strut 64, to which the lattice beams 16 of the booth ceiling module 14 are fastened. The strut 64 on one of the double supports 54 is shown in detail in FIG. 10.

Figure 10:
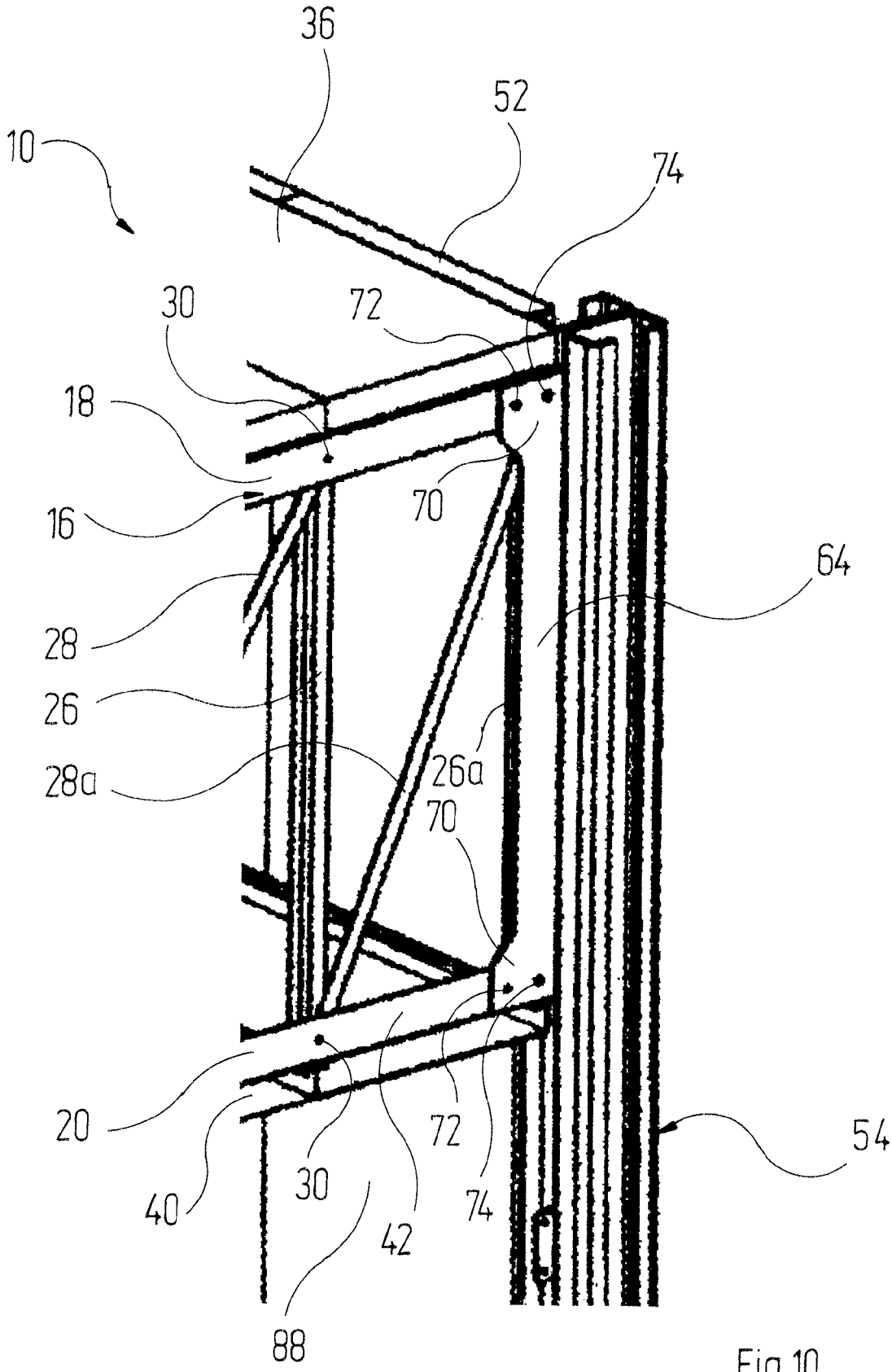
FIG. 10 schematically shows a detail view of the ceiling-and-wall module from FIG. 1 in the region of a strut for fastening the ceiling module.

The strut 64 is plate-shaped and made of sturdy material, for example steel. Seen perpendicularly to the rear walls of the support sections 56, the strut 64 is approximately rectangular. Its length in the longitudinal direction of the double support 54 corresponds to the distance between the closed bottom walls, facing away from one another, of the upper chords 18 and of the lower chords 20 of the lattice beams 16, as shown in FIGS. 1, 2 and 10. Its width parallel to the rear walls of the support sections 56 is approximately twice as great as the width of the support sections 56 there (FIG. 6). Approximately half of it projects into the region bounded by the two rear walls of the support sections 56, i.e. over the entire width of the latter.

Passing through the rear walls of the support sections 56 and the strut 64 are a multiplicity of through-bolts 66, depicted in FIG. 6, which are arranged in two rows and connect the support sections 56 and the strut 64 firmly to one another.

The free part, not projecting between the support sections 56, of the strut 64 projects into the region between the two lattice beams 16 (at the top of FIG. 6), which are kept at a distance by the spacers 24 (FIG. 4) mentioned at the outset. The distance in the region of the long legs of the upper chords 18 and of the lower chords 20 is somewhat greater than the thickness of the strut 64. To compensate for the gap which thus results and the width of which is subject to a tolerance, compensating plates 68 with suitable thicknesses are arranged there on both sides of the strut 64 (FIG. 6).

On its longitudinal side facing away from the double support 54, the strut 64 has, in the region of the long legs of the upper chords 18 and of the lower chords 20, in each case one projection 70, shown in detail in FIG. 10. The projections 70 project beyond the otherwise straight longitudinal side of the strut 64. Each projection 70 projects, on its side facing the respective other projection 70, in the longitudinal direction of the strut 64, beyond the long leg of the upper chord 18 and of the lower chord 20, respectively. Situated in the projections 70 is in each case one first through-bore 72. At the same height as the first bores 72 seen in the longitudinal direction of the strut 64, in each case one second through-bore 74 is arranged in the strut 64.

The upper chord 18 and the lower chord 20 are, as illustrated in FIG. 6, each connected to the strut 64 by the through-bolts 30 and further through-bolts 76.

The through-bolts 30 pass through the compensating plates 68 and the second through-bore 74 in the strut 64.

The through-bolts 76, dimensioned somewhat smaller than the through-bolts 30, pass, at a distance from the outer tension and compression member 26, merely through the compensating plates 68 and the first through-bore in the strut 64.

Overall, the lattice beams 16 thus connect mutually opposite double supports 54 of the booth wall modules 12 in such a way that the booth wall modules 12 and the booth ceiling module 14 stabilise one another.

The double support 54 is surrounded over its entire length by a covering. The covering is composed of an inner covering housing part 78 and an outer covering housing part 80, as shown in FIGS. 6 to 9.

The inner covering housing part 78 encloses the approximately half region, facing the interior space (at the top of FIGS. 6 to 9) of the large-capacity booth, of the double support 54 from approximately the middle of the open wall of one support section 56 to approximately the middle of the open wall of the other support section 56.

At the longitudinal-side edges of the double support 54, the inner covering housing part 78 is bent at right angles. In the region of the strut 64 it has an appropriately dimensioned slot 82, shown in FIG. 6, through which the strut 64 passes.

The inner covering housing 78 is bolted by a multiplicity of through-bolts 84 to the webs 58, facing the interior space of the large booth, of the open walls of the support sections 56. Arranged between the webs 58 and the inner covering housing part 78 is in each case one distance-compensating sheet 85 of suitable thickness. The heads of the through-bolts 84 are situated in the respective interior space of the support sections 56. The length of the through-bolts 84 is dimensioned so as to additionally reach through a lateral bent edge of a coil sheet 86 of a C-panel 88. The C-panel 88 is a panel which is bent at two right angles at opposite edges.

Four such C-panels 88 are arranged beside one another between two double supports 54 bounding a booth wall module 12. The C-panels 88 are of equal width in the direction perpendicular to the double supports 54 and are each arranged in the plane of the side wall elements 52, situated thereabove, of the booth ceiling module 14 (FIGS. 1 and 2).

In the region of its edges running in the longitudinal direction of the double support 54, the inner covering housing part 78 is bent at right angles away from the double support 54, so that in each case one fastening region 90 for the outer covering housing part 80 is formed there. A multiplicity of through-bores, hidden in FIGS. 6 to 9, are provided in the fastening regions 90 in the longitudinal direction of the double support 54, at the openings, facing the booth ceiling modules 14, of which through-bores in each case one nut 92 for a through-bolt 94 for fastening the outer covering housing part 80 is held by a retaining spring 96 even without the through-bolt 94.

Apart from its fastening regions 98, the outer covering housing part 80 is constructed in a corresponding fashion to the inner covering housing part 78. The outer covering housing part 80 is not bolted to the webs 58, facing away from the interior space of the large-capacity booth, on the open sides of the support sections 56. Instead, it is placed on the double support 54, from the outer side of the latter facing away from the booth interior, and is bolted at its fastening regions 98 to the fastening regions 90 of the inner covering housing part 78 by the through-bolts 94 described above.

Following the fastening regions 98, the outer covering housing part 80 continues in each case after a 90° bend in the direction of the interior space of the large-capacity booth and merges into an overlapping region 100, which extends as far as a covering sheet 102 for an insulating layer 104 of the C-panel 88.

The overlapping regions 100 hide the corresponding lateral bent edges of the C-panels 88 and the above-mentioned bolted connections to the webs 58 of the open walls of the support sections 56.

On the sides, facing away from the supporting sections 56, of the lateral bent edges of the coil sheets 86 of the C-panels 88, stabilisers 106 of U-shaped section are additionally arranged. Each stabiliser 106 extends in the longitudinal direction of the double supports 54 over the entire height of the coil sheets 86. Its closed wall rests against the region, resting against the web 58 of the support section 56, of the lateral bent edge of the coil sheet 86. One leg of the stabiliser 106 rests against that leg of the coil sheet 86 facing away from the booth and is bolted to this leg by through-bolts 108. The nuts for these through-bolts 108 are held on the legs of the stabilisers 106 by retaining springs even in the non-assembled state, which facilitates assembly. The other leg presses against the surface, facing away from the booth interior, of the covering sheet 102 of the C-panel 88 and thus firmly holds the insulating layer 104 on the inner wall of the coil sheet 86.

The through-bolts 84, by which the inner covering housing parts 78 is bolted to those webs 58 of the support sections 56 facing the large booth, each pass through the closed walls of the stabilisers 106; the corresponding nuts are situated in the inner region of the stabilisers 106.

The strut 64 extends over the height of the booth ceiling module 14. Below the strut 64, each double support 54 has, instead of the strut 64, a spacer sheet 110, which corresponds to the thickness of the strut 64 and is shown in FIGS. 7 to 9.

Figure 7:
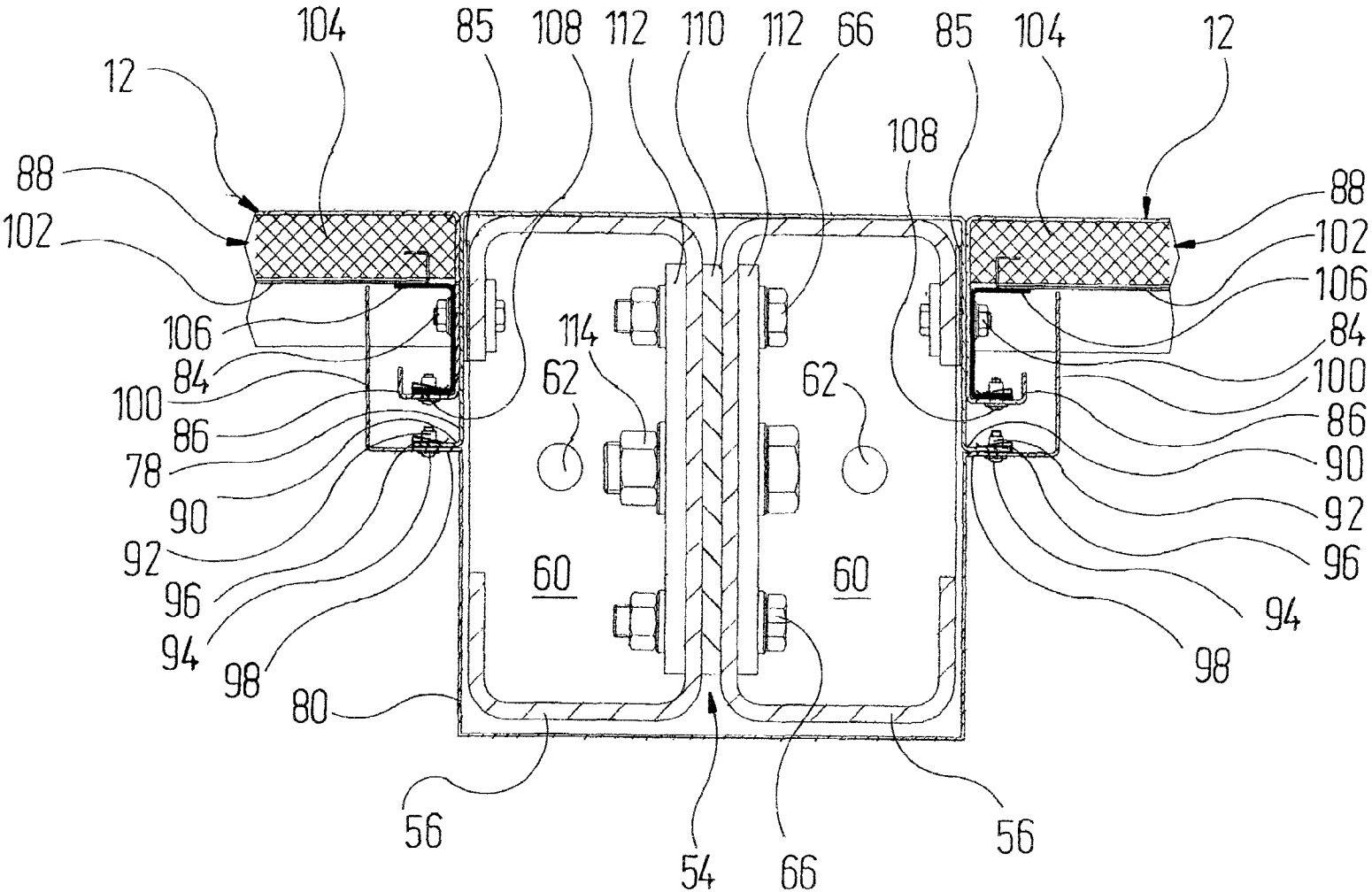
FIG. 7 schematically shows a horizontal section of the double support according to FIG. 6 in the region of upper C-panels.

FIG. 7 shows a cross-section of the double support 54 from FIG. 6 below the strut 64 in the region of the C-panels 88. Here, in contrast to the region shown in FIG. 6, on the inner surfaces of the closed rear walls of the support sections 56 there is arranged in each case one reinforcing sheet 112, through which pass the through-bolts 66 located there. Between the two rows of through-bolts 66, a third row with somewhat larger dimensioned through-bolts 114 is additionally arranged there.

Figure 8:
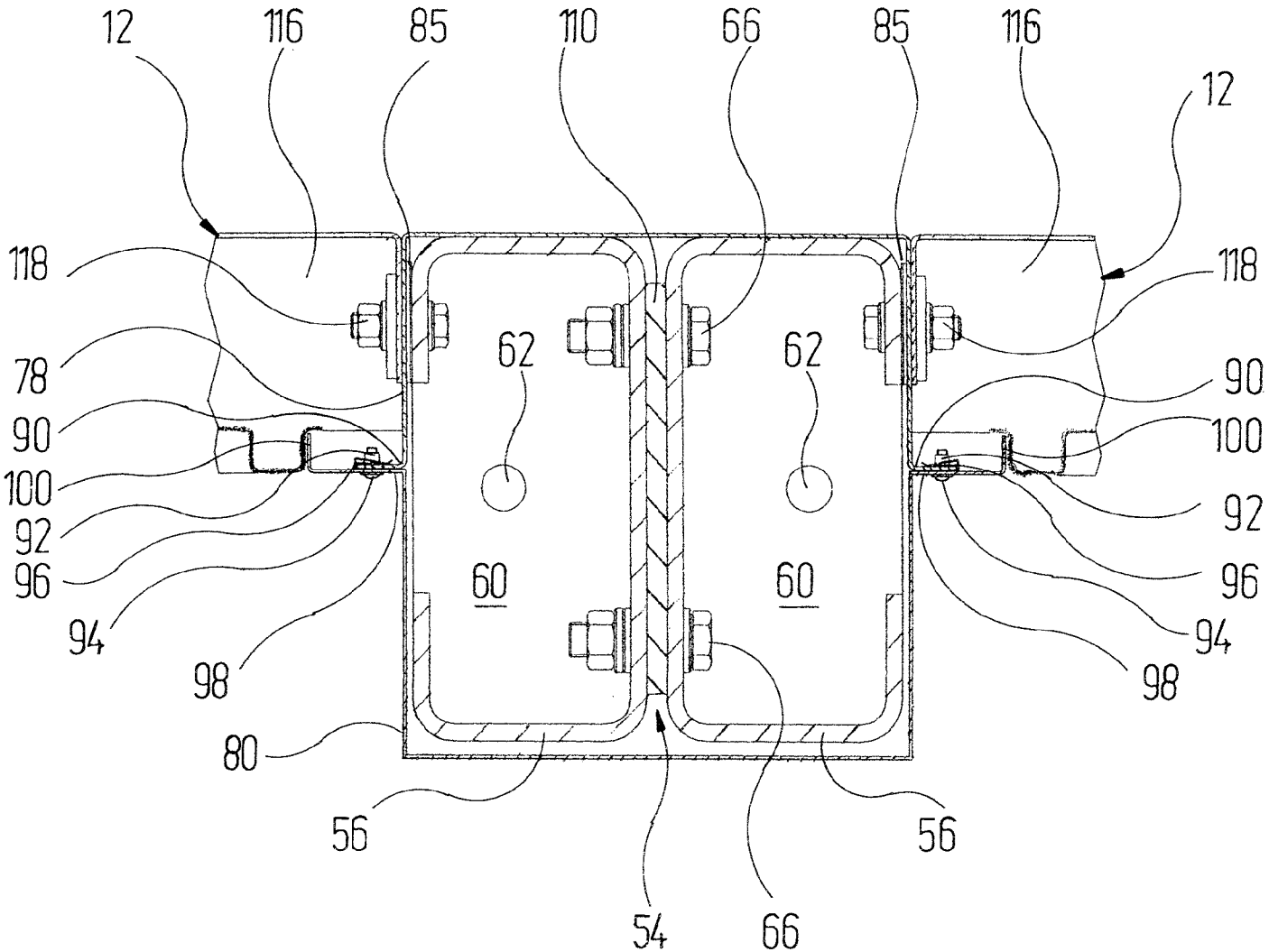
FIG. 8 schematically shows a horizontal section of the double support according to FIG. 6 in the region of a transition from the upper C-panels to lower SBS-panels.
Figure 9:
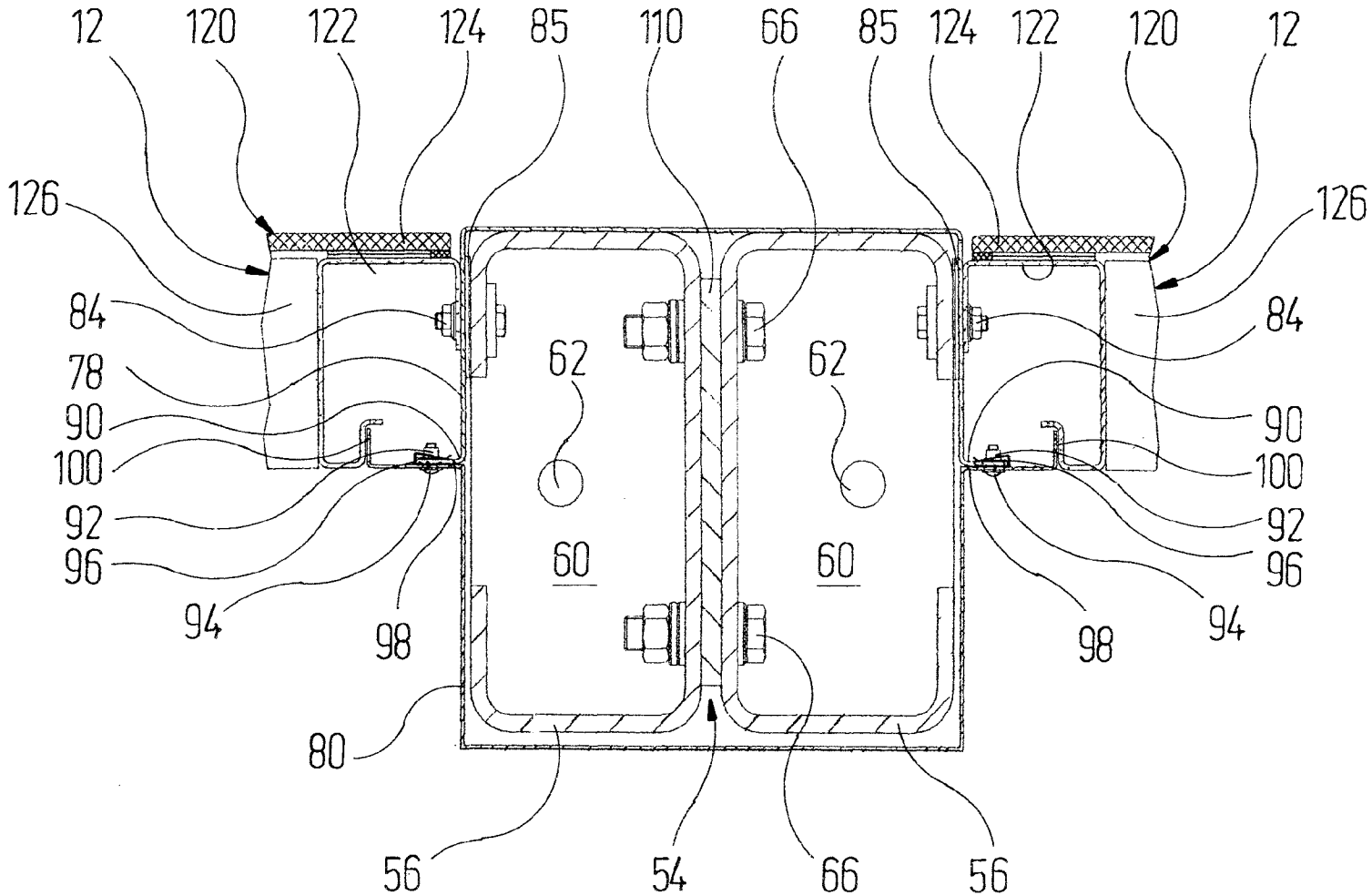
FIG. 9 schematically shows a horizontal section of the double support according to FIG. 6 in the region of lower SBS-panels.

FIG. 8 shows a cross-section of the double support 54 from FIGS. 6 and 7 below the C-panels 88 in the region of transom sections 116, which connect the two double supports 54 of the corresponding booth wall module 12 horizontally. Each transom section 116 is connected at a lateral bent edge to that leg of the corresponding support section 56 facing the booth interior by a through-bolt 118.

Below the transom section 116, each booth wall module 12 comprises a spray booth system panel (SBS-panel 120) which extends in a planar manner between the two double supports 54. SBS-panels, which are used as walls for booths of a painting installation, are described for example in DE 197 39 642 C2, column 4, line 12 to column 6, line 4. Each SBS-panel 120 has two SBS-supports 122 (FIG. 9), which extend in the longitudinal direction of the double supports 54 of the booth wall module 12 and at which it is bolted in each case analogously to the C-panels 88 to one of the double supports 54 of the booth wall module 12. The SBS-supports 122 are made of sheet metal bent along a rectangle in cross-section. The edge of the SBS-supports 122 which corresponds to that corner of the imaginary rectangle facing the booth interior and the double support 54 of the booth wall module 12, is missing. The wall adjoining the overlapping region 100 of the inner covering housing part 78 is bent approximately in an S-shape, in such a way that it forms a kind of labyrinth with the overlapping region 100.

On the longitudinal walls facing the booth interior, the two SBS-supports 122 of the SBS-panel 120 carry a glass wall 124. In the region of their ends, the two SBS-supports 122 are each connected by a horizontally running crossbar 126.

The overlapping region 100 of the outer covering housing part 80 is shorter, in the region of the transom sections 116 and of SBS-panels 120 shown in FIGS. 1, 2 and 9, than in the region of the C-panels 88. This is necessary, since the SBS-panels 120 are thicker than the C-panels 88. In the region of the transom sections 116, a transition to the respective SBS-supports 122 of the SBS-panels 120 is thus already created.

The gaps between the inner covering housing part 78 and the C-panels 88, the SBS-panels 120 and the transom sections 116 are sealed.

Holes, not shown in FIGS. 1 to 9, for the passing-through of fluid lines, power supply lines or control/signal lines pass through the rear walls of the two support sections 56, the spacer sheet 110 and optionally the reinforcing sheets 112, at required locations. The lines may already be laid in the prefabricated booth wall modules 12 and provided with preassembled connections which can be simply connected on final assembly of the large-capacity booth.

For the treatment of fuselages, one of the end sides, not illustrated in FIGS. 1 to 9, of the large-capacity booth may be closed by a docking wall, to which the fuselage is docked and which has an outlet for the internal ventilation of the fuselage.

The other end side is closable by a door, likewise not shown in FIGS. 1 to 9, through which the workpiece to be treated can be brought in and taken out.

In the above-described exemplary embodiment of a large-capacity booth, the following modifications, inter alia, are possible:

The use of the large-capacity booth is not limited to the treatment of motor vehicles, rail vehicles, aircraft or watercraft. Rather, other large workpieces, for example turbines, may also be treated in it. Instead of spraying and drying, other treatments may also be carried out.

The large-capacity booth may also be open, or closable by curtains, at the end sides.

The large-capacity booth may also consist of only a single ceiling-and-wall module 10.

The booth walls may, in addition to the lateral support sections 56, also have intermediate supports. Likewise, the booth ceilings may, in addition to the lateral lattice beams 16, also have intermediate lattice beams arranged between the latter.

Also, it is possible for only the booth ceilings to be prefabricated as modules.

The booth ceiling modules 14 may, on the side on which they do not adjoin an adjacent booth ceiling module 14, also have double lattice beams 16.

Likewise, the booth wall modules 12 may, on the side on which they do not adjoin a neighbouring booth wall module 12, also have double supports 54.

It is also possible for only the connections of wall and ceiling elements 36, 52, 88, 116, 120 to the support sections 56 and the lattice beams 16 to be bolted. All other connections, preferably those carried out at the factory, may, for example, also be riveted or welded.

Instead of SBS-panels 120 and C-panels 88, other kinds of wall elements may also be used.

The upper chords 18, the lower chords 20 and/or the tension and compression members 26, instead of being U-shaped sectional elements, may, for example, also be C-shaped sectional elements.

Likewise, the support sections 56 of the double supports 54 may, for example, also be U-shaped.

The upper chords 18, the lower chords 20, the tension and compression members 26, the tension members 28 and the support sections 56, instead of being cut and bent sheet-metal parts, may, for example, be shaped parts produced in another manner. Aluminium or composite materials, for example, may also be used here.

In addition to the struts 64, it is also possible to provide, also at other places between the support sections 56 of a double support 54, other kinds of struts for fastening a lifting platform and/or static elements, for example crossbeams.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. A large-capacity booth for the treatment of workpieces, the booth having at least two opposite booth walls and one booth ceiling, wherein the booth walls each have at least two vertical supports including open sectional elements and wall elements which connect the at least two vertical supports to one another, and the booth ceiling has at least two lattice beams extending in a planar manner in the vertical direction and having open sectional elements, and the lattice beams connect mutually opposite supports of the booth walls in such a way that the booth walls and the booth ceiling stabilise one another, wherein one strut is connected firmly to each of the at least two vertical supports, and the at least two lattice beams are fastened to the struts, and wherein the struts are plate-shaped and extend at least over a height of the booth ceiling.

2. The large-capacity booth of claim 1, wherein the booth ceiling and/or the booth walls further include modules.

3. The large-capacity booth of claim 2, wherein each booth ceiling module has, at least on the side on which it adjoins an adjacent booth ceiling module, one of the lattice beams, which is closely connected to the corresponding lattice beam of the adjacent booth ceiling module.

4. The large-capacity booth of claim 2, wherein each booth wall module has, at least on the side on which it adjoins an adjacent booth wall module, one of the supports, which is closely connected to the corresponding support of the adjacent booth wall module.

5. The large-capacity booth of claim 1, wherein the connections of the supports to the wall elements and the lattice beams are detachable.

6. The large-capacity booth of claim 1, wherein the wall elements are spray booth system-walls and/or C-panels which are bent at two right angles at opposite edges.

7. The large-capacity booth of claim 1, wherein the sectional elements of the lattice beams have U-shaped sections.

8. The large-capacity booth of claim 1, wherein the sectional elements of the supports have C-shaped sections.

9. The large-capacity booth of claim 1, wherein the sectional elements are bent from flat material.

10. The large-capacity booth of claim 9, wherein the flat material is cut and bent sheet-metal parts.

11. The large-capacity booth of claim 5, wherein the connections include bolts.

12. The large-capacity booth of claim 3, wherein each booth wall module has, at least on the side on which it adjoins an adjacent booth wall module, one of the supports, which is closely connected to the corresponding support of the adjacent booth wall module.

13. The large-capacity booth of claim 12, wherein the connections of the supports to the wall elements and the lattice beams are detachable.

14. The large-capacity booth of claim 12, wherein the wall elements are spray booth system-walls and/or C-panels.

15. The large-capacity booth of claim 12, wherein the sectional elements of the lattice beams have U-shaped sections.

16. The large-capacity booth of claim 12, wherein the sectional elements of the supports have C-shaped sections.

17. The large-capacity booth of claim 2, wherein the connections of the supports to the wall elements and the lattice beams are detachable.

18. The large-capacity booth of claim 2, wherein the wall elements are spray booth system-walls and/or C-panels.

19. The large-capacity booth of claim 2, wherein the sectional elements of the lattice beams have U-shaped sections.

20. The large-capacity booth of claim 2, wherein the sectional elements of the supports have C-shaped sections.

* * * * *